US009845658B1

(12) United States Patent
Nish et al.

(10) Patent No.: US 9,845,658 B1
(45) Date of Patent: Dec. 19, 2017

(54) LIGHTWEIGHT, EASILY DRILLABLE OR MILLABLE SLIP FOR COMPOSITE FRAC, BRIDGE AND DROP BALL PLUGS

(71) Applicant: Albany Engineered Composites, Inc., Rochester, NH (US)

(72) Inventors: Randall Williams Nish, Provo, UT (US); Michael Chris Petrogeorge, Bluffdale, UT (US)

(73) Assignee: Albany International Corp., Rochester, NH (US)

( * ) Notice: Subject to any disclaimer, the term of this patent is extended or adjusted under 35 U.S.C. 154(b) by 266 days.

(21) Appl. No.: 14/689,380

(22) Filed: Apr. 17, 2015

(51) Int. Cl.

| | |
|---|---|
| ***E21B 33/12*** | (2006.01) |
| ***E21B 33/129*** | (2006.01) |
| ***E21B 33/128*** | (2006.01) |
| ***E21B 23/06*** | (2006.01) |

(52) U.S. Cl.
CPC ..... *E21B 33/1293* (2013.01); *E21B 23/06* (2013.01); *E21B 33/128* (2013.01)

(58) Field of Classification Search
CPC ..... E21B 33/1293; E21B 23/06; E21B 33/128
USPC ..... 166/135
See application file for complete search history.

(56) References Cited

U.S. PATENT DOCUMENTS

| | | | |
|---|---|---|---|
| 2,043,225 | A | 6/1936 | Armentrout et al. |
| 2,160,804 | A | 5/1939 | Hall et al. |
| 2,205,119 | A | 6/1940 | Hall et al. |
| 2,230,712 | A | 2/1941 | Bendeler et al. |
| 2,249,172 | A | 7/1941 | Quintrell |
| 2,338,326 | A | 1/1944 | Green |
| 2,577,068 | A | 12/1951 | Baker |
| 2,589,506 | A | 3/1952 | Morrisett |
| 2,672,199 | A | 3/1954 | McKenna |
| 2,725,941 | A | 12/1955 | Hanshaw |
| 2,785,758 | A | 3/1957 | Baker |
| 3,021,902 | A | 2/1962 | Keithahn |
| 3,136,365 | A | 6/1964 | Carter et al. |
| 3,148,731 | A | 9/1964 | Holden |
| 3,163,225 | A | 12/1964 | Perkins |
| 3,211,232 | A | 10/1965 | Grimmer |
| 3,298,440 | A | 1/1967 | Current |
| 3,306,366 | A | 2/1967 | Muse |
| 3,314,480 | A | 4/1967 | Scott |
| 3,420,304 | A | 1/1969 | Kilgore |
| 3,497,003 | A | 2/1970 | Berryman et al. |
| 3,506,067 | A | 4/1970 | Lebourg |
| 3,517,742 | A | 6/1970 | Williams |
| 3,570,595 | A | 3/1971 | Berryman |
| 3,831,677 | A | 8/1974 | Mullins |

(Continued)

*Primary Examiner* — Taras P Bemko
(74) *Attorney, Agent, or Firm* — McCarter & English LLP

(57) ABSTRACT

A frangible slip ring is disposable on a mandrel of a plug disposable in a casing of an oil or gas well. The slip ring is radially expandable during setting to fragment and radially expand to engage the casing. A plurality of external teeth are formed in an exterior of the slip ring, and spaced-apart axially along the slip ring. The plurality of teeth is radially segmented around a circumference of the slip ring by a plurality of axial slots spaced-apart around the circumference of the slip ring and extending into the exterior of the slip ring. An interior of the slip ring is axially segmented along a longitudinal axis by a plurality of annular grooves spaced-apart along the longitudinal axis of the slip ring and extending into the interior of the slip ring.

17 Claims, 7 Drawing Sheets

(56) References Cited

U.S. PATENT DOCUMENTS

| | | | |
|---|---|---|---|
| 3,976,133 | A | 8/1976 | Allen |
| 4,099,563 | A | 7/1978 | Hutchison et al. |
| 4,151,875 | A | 5/1979 | Sullaway |
| 4,285,398 | A | 8/1981 | Zandmer et al. |
| 4,289,200 | A | 9/1981 | Fisher, Jr. |
| 4,312,406 | A | 1/1982 | McLaurin et al. |
| 1,684,266 | A | 9/1982 | Fisher et al. |
| 4,359,090 | A | 11/1982 | Luke |
| 4,397,351 | A | 8/1983 | Harris |
| 4,432,418 | A | 2/1984 | Mayland |
| 4,488,595 | A | 12/1984 | Akkerman |
| 4,524,825 | A | 6/1985 | Fore |
| 4,532,989 | A | 8/1985 | Barker |
| 4,542,788 | A | 9/1985 | Semar |
| 4,553,596 | A | 11/1985 | Graham et al. |
| 4,664,188 | A | 5/1987 | Zunkel et al. |
| 4,665,977 | A | 5/1987 | Mullins |
| 4,708,202 | A | 11/1987 | Sukup et al. |
| 4,730,835 | A | 3/1988 | Wilcox et al. |
| 4,739,829 | A | 4/1988 | Brunner |
| 4,745,972 | A | 5/1988 | Bell et al. |
| 4,784,226 | A | 11/1988 | Wyatt |
| 4,813,481 | A | 3/1989 | Sproul et al. |
| 4,834,184 | A | 5/1989 | Streich et al. |
| 4,858,687 | A | 8/1989 | Watson et al. |
| 4,926,938 | A | 5/1990 | Lindsey, Jr. |
| 4,984,636 | A | 1/1991 | Bailey et al. |
| 5,086,839 | A | 2/1992 | Setterberg, Jr. et al. |
| 5,095,978 | A | 3/1992 | Akkerman et al. |
| 5,131,468 | A | 7/1992 | Lane et al. |
| 5,188,182 | A | 2/1993 | Echols, III et al. |
| 5,224,540 | A | 7/1993 | Streich et al. |
| 5,253,709 | A | 10/1993 | Kendrick et al. |
| 5,271,468 | A | 12/1993 | Streich et al. |
| 5,333,684 | A | 8/1994 | Walter et al. |
| 5,340,626 | A | 8/1994 | Head |
| 5,390,737 | A | 2/1995 | Jacobi et al. |
| 5,392,856 | A | 2/1995 | Broussard, Jr. et al. |
| 5,404,956 | A | 4/1995 | Bohlen et al. |
| 5,413,172 | A | 5/1995 | Laurel |
| 5,422,183 | A | 6/1995 | Sinclair et al. |
| 5,441,111 | A | 8/1995 | Whiteford |
| 5,479,986 | A | 1/1996 | Gano et al. |
| 5,540,279 | A | 7/1996 | Branch et al. |
| 5,542,473 | A | 8/1996 | Pringle et al. |
| 5,553,667 | A | 9/1996 | Budde et al. |
| 5,597,784 | A | 1/1997 | Sinclair et al. |
| 5,607,017 | A | 3/1997 | Owens et al. |
| 5,613,560 | A | 3/1997 | Jelinski et al. |
| 5,678,635 | A | 10/1997 | Dunlap et al. |
| 5,701,959 | A | 12/1997 | Hushbeck et al. |
| 5,749,419 | A | 5/1998 | Coronado et al. |
| 5,765,641 | A | 6/1998 | Shy et al. |
| 5,787,979 | A | 8/1998 | Giroux et al. |
| 5,813,457 | A | 9/1998 | Giroux et al. |
| 5,819,846 | A | 10/1998 | Bolt, Jr. |
| 5,837,656 | A | 11/1998 | Sinclair et al. |
| 5,839,515 | A | 11/1998 | Yuan et al. |
| 5,904,207 | A | 5/1999 | Rubbo et al. |
| 5,924,696 | A | 7/1999 | Frazier |
| 5,941,309 | A | 8/1999 | Appleton |
| 5,984,007 | A | 11/1999 | Yuan et al. |
| 5,990,051 | A | 11/1999 | Ischy et al. |
| 6,009,944 | A | 1/2000 | Gudmestad |
| 6,026,903 | A | 2/2000 | Shy et al. |
| 6,056,053 | A | 5/2000 | Giroux et al. |
| 6,076,600 | A | 6/2000 | Vick, Jr. et al. |
| 6,082,451 | A | 7/2000 | Giroux et al. |
| 6,131,663 | A | 10/2000 | Henley et al. |
| 6,145,593 | A | 11/2000 | Hennig |
| 6,167,957 | B1 | 1/2001 | Frazier |
| 6,167,963 | B1 | 1/2001 | McMahan et al. |
| 6,189,618 | B1 | 2/2001 | Beeman et al. |
| 6,220,349 | B1 | 4/2001 | Vargus et al. |
| 6,220,350 | B1 | 4/2001 | Brothers et al. |
| 6,244,642 | B1 | 6/2001 | Serafin et al. |
| 6,279,656 | B1 | 8/2001 | Sinclair et al. |
| 6,318,461 | B1 | 11/2001 | Carisella |
| 6,318,729 | B1 | 11/2001 | Pitts, Jr. et al. |
| 6,354,372 | B1 | 3/2002 | Carisella et al. |
| 6,394,180 | B1 | 5/2002 | Berscheidt et al. |
| 6,412,388 | B1 | 7/2002 | Frazier |
| 6,431,274 | B1 | 8/2002 | Nowlin et al. |
| 6,481,496 | B1 | 11/2002 | Jackson et al. |
| 6,491,108 | B1 | 12/2002 | Slup et al. |
| 6,491,116 | B2 | 12/2002 | Berscheidt et al. |
| 6,540,033 | B1 | 4/2003 | Sullivan et al. |
| 6,578,633 | B2 | 6/2003 | Slup et al. |
| 6,581,681 | B1 | 6/2003 | Zimmerman et al. |
| 6,598,672 | B2 | 7/2003 | Bell et al. |
| 6,598,679 | B2 | 7/2003 | Robertson |
| 6,599,863 | B1 | 7/2003 | Palmer et al. |
| 6,651,738 | B1 | 11/2003 | Solfronk et al. |
| 6,651,743 | B2 | 11/2003 | Szarka |
| 6,655,459 | B2 | 12/2003 | MacKay |
| 6,666,275 | B2 | 12/2003 | Neal et al. |
| 6,695,050 | B2 | 2/2004 | Winslow et al. |
| 6,695,051 | B2 | 2/2004 | Smith et al. |
| 6,708,768 | B2 | 3/2004 | Slup et al. |
| 6,708,770 | B2 | 3/2004 | Slup et al. |
| 6,712,153 | B2 | 3/2004 | Turley et al. |
| 6,732,822 | B2 | 5/2004 | Slack et al. |
| 6,752,209 | B2 | 6/2004 | Mondelli et al. |
| 6,769,491 | B2 | 8/2004 | Zimmerman et al. |
| 6,793,022 | B2 | 9/2004 | Vick et al. |
| 6,796,376 | B2 | 9/2004 | Frazier |
| 6,799,638 | B2 | 10/2004 | Butterfield, Jr. |
| 6,827,150 | B2 | 12/2004 | Luke |
| 6,976,534 | B2 | 12/2005 | Sutton et al. |
| 6,986,390 | B2 | 1/2006 | Doane et al. |
| 7,017,672 | B2 | 3/2006 | Owen, Sr. |
| 7,036,602 | B2 | 5/2006 | Turley et al. |
| 7,044,230 | B2 | 5/2006 | Starr et al. |
| 7,049,272 | B2 | 5/2006 | Sinclair et al. |
| 7,093,664 | B2 | 8/2006 | Todd et al. |
| 7,124,831 | B2 | 10/2006 | Turley et al. |
| 7,163,066 | B2 | 1/2007 | Lehr |
| 7,168,494 | B2 | 1/2007 | Starr et al. |
| 7,210,533 | B2 | 5/2007 | Starr et al. |
| 7,255,178 | B2 | 8/2007 | Slup et al. |
| 7,258,165 | B1 | 8/2007 | Williams |
| 7,273,099 | B2 | 9/2007 | East, Jr. et al. |
| 7,287,596 | B2 | 10/2007 | Frazier et al. |
| 7,322,413 | B2 | 1/2008 | Rogers et al. |
| 7,337,852 | B2 | 3/2008 | Manke et al. |
| 7,350,582 | B2 | 4/2008 | McKeachnie et al. |
| 7,353,879 | B2 | 4/2008 | Todd et al. |
| 7,373,973 | B2 | 5/2008 | Smith et al. |
| 7,380,600 | B2 | 6/2008 | Willberg et al. |
| 7,395,856 | B2 | 7/2008 | Murray |
| 7,452,161 | B2 | 11/2008 | Freyer et al. |
| 7,455,118 | B2 | 11/2008 | Roberts et al. |
| 7,461,699 | B2 | 12/2008 | Richard et al. |
| 7,464,764 | B2 | 12/2008 | Xu |
| 7,475,736 | B2 | 1/2009 | Lehr et al. |
| 7,510,018 | B2 | 3/2009 | Williamson et al. |
| 7,735,549 | B1 | 6/2010 | Nish et al. |
| 7,743,836 | B2 | 6/2010 | Cook et al. |
| 7,789,135 | B2 | 9/2010 | Turley et al. |
| 7,900,696 | B1 | 3/2011 | Nish et al. |
| 7,980,300 | B2 | 7/2011 | Roberts et al. |
| 8,127,856 | B1 | 3/2012 | Nish et al. |
| 8,267,177 | B1 | 9/2012 | Vogel et al. |
| 8,403,036 | B2 | 3/2013 | Neer et al. |
| 8,579,023 | B1 | 11/2013 | Nish et al. |
| 8,579,024 | B2 | 11/2013 | Mailand et al. |
| 8,678,081 | B1 | 3/2014 | Nish |
| 8,746,342 | B1 | 6/2014 | Nish et al. |
| 8,770,276 | B1 | 7/2014 | Nish et al. |
| 8,997,859 | B1 | 4/2015 | Ackermann |
| 2002/0070503 | A1 | 6/2002 | Zimmerman et al. |
| 2002/0162662 | A1 | 11/2002 | Passamaneck et al. |
| 2003/0155112 | A1 | 8/2003 | Tiernan et al. |
| 2003/0188862 | A1 | 10/2003 | Steich et al. |

(56) References Cited

U.S. PATENT DOCUMENTS

| | | | |
|---|---|---|---|
| 2003/0226660 | A1 | 12/2003 | Winslow et al. |
| 2004/0003928 | A1 | 1/2004 | Frazier |
| 2004/0036225 | A1 | 2/2004 | Ritter et al. |
| 2004/0045723 | A1 | 3/2004 | Slup et al. |
| 2004/0177952 | A1 | 9/2004 | Turley et al. |
| 2005/0077053 | A1 | 4/2005 | Walker et al. |
| 2005/0161224 | A1 | 7/2005 | Starr et al. |
| 2005/0189103 | A1 | 9/2005 | Roberts et al. |
| 2005/0205264 | A1 | 9/2005 | Starr et al. |
| 2006/0124307 | A1 | 6/2006 | Turley et al. |
| 2006/0131031 | A1 | 6/2006 | McKeachnie et al. |
| 2006/0278405 | A1 | 12/2006 | Turley et al. |
| 2007/0039160 | A1 | 2/2007 | Turley et al. |
| 2007/0074873 | A1 | 4/2007 | McKeachnie et al. |
| 2007/0102165 | A1 | 5/2007 | Slup et al. |
| 2007/0119600 | A1 | 5/2007 | Slup et al. |
| 2007/0284097 | A1 | 12/2007 | Swor et al. |
| 2007/0284114 | A1 | 12/2007 | Swor et al. |
| 2008/0047717 | A1 | 2/2008 | Frazier et al. |
| 2008/0060821 | A1 | 3/2008 | Smith et al. |
| 2008/0073074 | A1 | 3/2008 | Frazier |
| 2008/0073081 | A1 | 3/2008 | Frazier et al. |
| 2008/0073086 | A1 | 3/2008 | Cook et al. |
| 2008/0202764 | A1 | 8/2008 | Clayton et al. |
| 2008/0257549 | A1 | 10/2008 | Swor et al. |
| 2008/0308266 | A1* | 12/2008 | Roberts ..... E21B 33/1204 166/118 |
| 2009/0000792 | A1 | 1/2009 | Turley et al. |
| 2009/0038790 | A1 | 2/2009 | Barlow |
| 2009/0044957 | A1 | 2/2009 | Clayton et al. |
| 2009/0065194 | A1 | 3/2009 | Frazier |
| 2009/0065216 | A1 | 3/2009 | Frazier |
| 2009/0078647 | A1 | 3/2009 | Frazier et al. |
| 2009/0139720 | A1 | 6/2009 | Frazier |
| 2009/0159274 | A1 | 6/2009 | Frazier |
| 2009/0178808 | A1 | 7/2009 | Williamson et al. |
| 2010/0024703 | A1 | 2/2010 | Zampiello et al. |
| 2010/0155050 | A1 | 6/2010 | Frazier |
| 2010/0276159 | A1 | 11/2010 | Mailand et al. |
| 2010/0282004 | A1 | 11/2010 | Nance et al. |
| 2010/0288487 | A1 | 11/2010 | Turley et al. |
| 2011/0079383 | A1 | 4/2011 | Porter et al. |
| 2012/0125642 | A1* | 5/2012 | Chenault ..... E21B 33/1204 166/387 |
| 2013/0048271 | A1 | 2/2013 | VanLue |

* cited by examiner

LIGHTWEIGHT, EASILY DRILLABLE OR MILLABLE SLIP FOR COMPOSITE FRAC, BRIDGE AND DROP BALL PLUGS

BACKGROUND

Field of the Invention

The present invention relates generally to plugs for oil and gas well completion. More particularly, the present invention relates to slips for such plugs.

Related Art

There are three general categories of land based or and gas wells. They are vertical, deviated and horizontal wells. Deviated and horizontal wells are made possible by directional drilling technology. Traditional oil and gas wells are drilled through rock and lined with steel pipe backed with cement that bridges the gap between the pipe and the rock face. The steel and cement barrier blocks the flow of oil or gas into the steel casing, from where it is raised to the surface. To restore flow from the rock formation to the steel casing, oil and gas wells are "completed" using a complex process involving explosive charges and high pressure fluids. The steel/cement barrier is "perforated" with explosive shaped charges which "drill" holes through the steel casing and the cement, and into the rock. The shaped charge breaks up the rock and creates fracture lines that can be opened up with pressurized fluids. High pressure fluids and proppants (spherical sand or synthetic ceramic beads) are then pumped down the well, through the holes in the steel pipe and into the rock formation to prepare the rock for the flow of gas and oil into the casing and up the well. This fracturing process is repeated as many times as needed.

Another technological improvement has been the use of composite plugs used to complete these unconventional wells (i.e. deviated and horizontal). As they prepare to perforate at each level, well technicians set a temporary plug in the bore of the steel casing pipe just below where they will perforate. The plug prevents fluid from flowing lower in the well and it allows them to pump "frac fluids" and sand down to the perforations and into the reservoir. This fractures the rock and props open the fractures allowing the movement of gas or oil at that level. Use of the temporary plug prevents contaminating the already completed zones below the plug. This process is repeated up the well until all desired zones have been stimulated. At each level, the temporary plugs are left in place, so that they can all be drilled out at the end of the process, in a single (but often time-consuming) operation. The ability to drill all the temporary composite plugs in a single pass (often taking only one day) compared to taking days or weeks to drill cast iron plugs has radically changed well completion economics. In the horizontal wells it would be almost impossible to drill out a cast iron plug.

Permanent and temporary plugs are locked to the casing using a system of cones and slips. The slip is typically made from cast iron or combinations of cast iron, ceramic buttons and composite materials. Each slip has hardened teeth or ceramic buttons that bite into the steel casing wall to lock the slip in place. The inside face of each slip usually consists of a conical surface that acts as a wedge. The slip's conical wedge face acts against a conical wedge formed by a cone. The cone is usually made from cast iron, aluminum or composite materials. The purpose of the cone is to act as a wedge to keep the slips locked in place and to provide support for the elastomeric elements used to seal the well bore.

The face between the slip and cone can also be flat rather than conical as long as both faces have the needed wedge to lock themselves together and react forces from the plug. When the plug is set, a setting sleeve compresses the stack of slips, cones and rubber elements. The rubber elements expand outward and inward and create a seal between the elements and mandrel, and the elements and the well casing. The rubber elements also act on one to two layers of sheet metal petals and force them into contact with the inner diameter of the steel casing. This prevents the rubber elements from extruding past the petals. The lock ring engages the threads in the mandrel and the threads in the push sleeve to prevent backward (i.e. upward) movement once the force from the setting tool is released. This locking action keeps pressure on the elements which preserves the seal and keeps the slips locked to the interior of the casing. This blocks fluid from getting to the lower zones and creates the seal needed to perform hydraulic fracturing in the layers above the plug.

Drilling out composite plugs in horizontal wells is more difficult because gravity does not act to keep a favorable weight on the drill bit during drill out. Lower fluid flows at the milling or drilling face are also a problem.

Some plugs use a one piece cast iron slip and one piece composite cone made from fiberglass/epoxy material. The slips have axial slots or grooves which are used to set the breaking strength and spacing of the slip segments. The cones have brass pins used to crack and separate the broken slip segments. This slip design was optimized for vertical and deviated wells where it was possible to get a lot of weight on the drill bit during composite plug drill out operations. The stick pipe used to drill out plugs in these wells also provided higher rotations per minute (RPM) and better fluid flows to the cutting face than the coiled tubing used for horizontal wells.

Cast iron plugs use a one piece cast iron slip and one piece cast iron cone. The slips have slots or grooves machined at equal intervals to assure the slips fracture when compressed and come in contact with the casing. The cones act as a conical wedge to fracture the slips and lock them in place against the casing wall. Cast iron plugs are not used in horizontal wells because they are too difficult to drill out.

When used in horizontal wells with lower weight on bit and lower fluid flows, the slip fragments tend to remain in larger pieces. The larger pieces are difficult to "lift" out of the well because of their weight. Consequently, they stay near the cutting face and are constantly impacting the drill bit and bottom hole assembly (BHA) thereby causing excessive wear and longer plug drill out times.

SUMMARY OF THE INVENTION

It has been recognized that it would be advantageous to develop a slip for a plug that facilitates drill out of the plug and removal of slip segments, particularly in horizontal wells. It has been recognized that it would be advantageous to develop a single-piece, cast iron slip for a plug that can be readily removed from an oil or gas well during drill-out.

The invention provides a plug disposable in a casing of an oil or gas well. The plug comprises a mandrel with an element disposed thereon compressible and radially expandable to seal between the mandrel and the casing. In addition, the plug comprises a slip ring disposed thereon and radially expandable to engage the casing. Furthermore, the plug comprises a cone adjacent the slip ring to radially displace the slip ring. The element, the slip ring and the cone are pressable against a mule shoe on the mandrel. The slip ring has a plurality of external teeth formed in an exterior of the slip ring, and spaced-apart axially along the slip ring. In addition, the slip ring has a plurality of axial slots spaced-apart around a circumference of the slip ring and extending into the exterior of the slip ring. Furthermore, the slip ring has a plurality of internal, annular grooves formed in an interior of the slip ring and axially spaced-apart from one another.

In addition, the invention provides a plug disposable in a casing of an oil or gas well. The plug comprises a mandrel and an element carried by the mandrel. The element is axially displaceable along the mandrel during setting, and compressible and radially expandable to seal between the mandrel and the casing when set. At least one frangible slip ring is carried by the mandrel, and is radially expandable during setting to fragment and engage the casing when set. At least one cone is carried by the mandrel and adjacent the at least one slip ring, and is axially displaceable during setting to fragment and radially displace the slip ring. A lower mule shoe is fixed with respect to the mandrel. The element, the at least one slip ring and the at least one cone are pressable against the lower mule shoe on the mandrel during setting. The slip ring has a tapering open end. The cone has a tapered circular frusto-conical end insertable into the tapering open end of the slip ring. A plurality of external teeth is formed in an exterior of the slip ring, and spaced-apart axially along the slip ring. The slip ring has a plurality of slots spaced-apart around a circumference of the slip ring and extending into the exterior of the slip ring. The slip ring has a plurality of internal, annular grooves formed in an interior of the slip ring and axially spaced-apart from one another.

Furthermore, the invention provides a frangible slip configured for a plug disposable in a casing of an oil or gas well. The slip comprises a frangible slip ring disposable on a mandrel, and radially expandable during setting to fragment and radially expand to engage the casing. A plurality of external teeth is formed in an exterior of the slip ring, and spaced-apart axially along the slip ring. The plurality of teeth is radially segmented around a circumference of the slip ring by a plurality of axial slots spaced-apart around the circumference of the slip ring and extending into the exterior of the slip ring. An interior of the slip ring is axially segmented along a longitudinal axis by a plurality of annular grooves spaced-apart along the longitudinal axis of the slip ring and extending into the interior of the slip ring. The plurality of axial slots form axial break lines along which the slip ring fragments during setting of the plug into a plurality of slip segments with internal, arcuate groove segments. The internal, arcuate groove segments form break lines along which the plurality of slip segments fragment during drill out.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The terms "upper" and "lower" are used herein with respect to the orientation of the plug in an upright, vertical orientation, even though the plug can be used in horizontal orientations or wells, where upper is still towards the upper end of the well and lower is still towards the lower end of the well.

The terms "casing", "pipe" and "well" are used interchangeably herein.

The terms "elements" and "packers" are used interchangeably herein.

The terms "slips" and "slip rings" are used interchangeably herein.

The terms "spool" and "mandrel" are used interchangeably herein.

The terms "cone" and "slip wedge" are used interchangeably herein.

The terms "anvil" and "lower portion" and "mule shoe" of the mandrel and/or the downhole tool are used interchangeably herein.

The terms "downhole tool" and "plug" and "mandrel assembly" are used interchangeably herein.

The terms "drill bit" and "mill" are used interchangeably herein.

The terms "oil well", "gas well", "oil or gas well" and "oil and gas well" are used interchangeably herein to refer to an oil and/or gas well producing oil, gas, or both.

Description

Figure 1A:
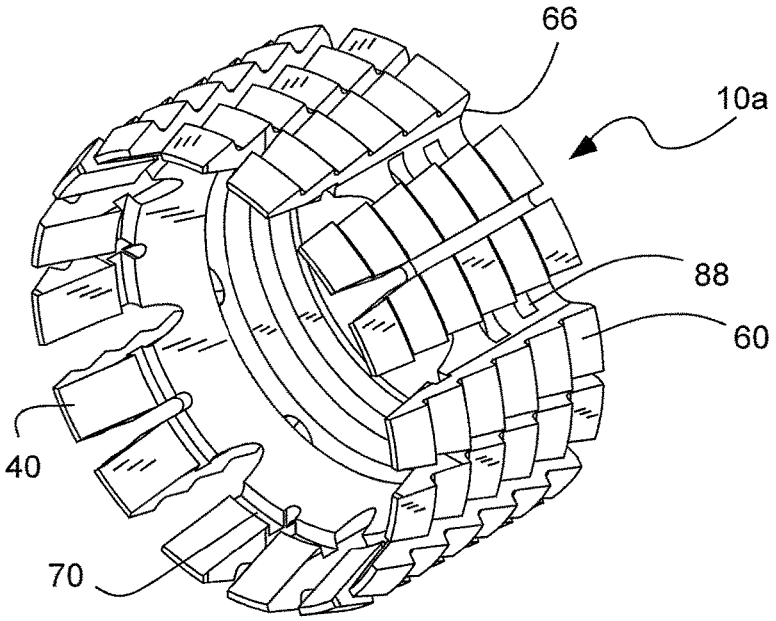
FIG. 1*a* is a perspective view of a slip for a plug in accordance with an embodiment of the present invention.
Figure 1B:
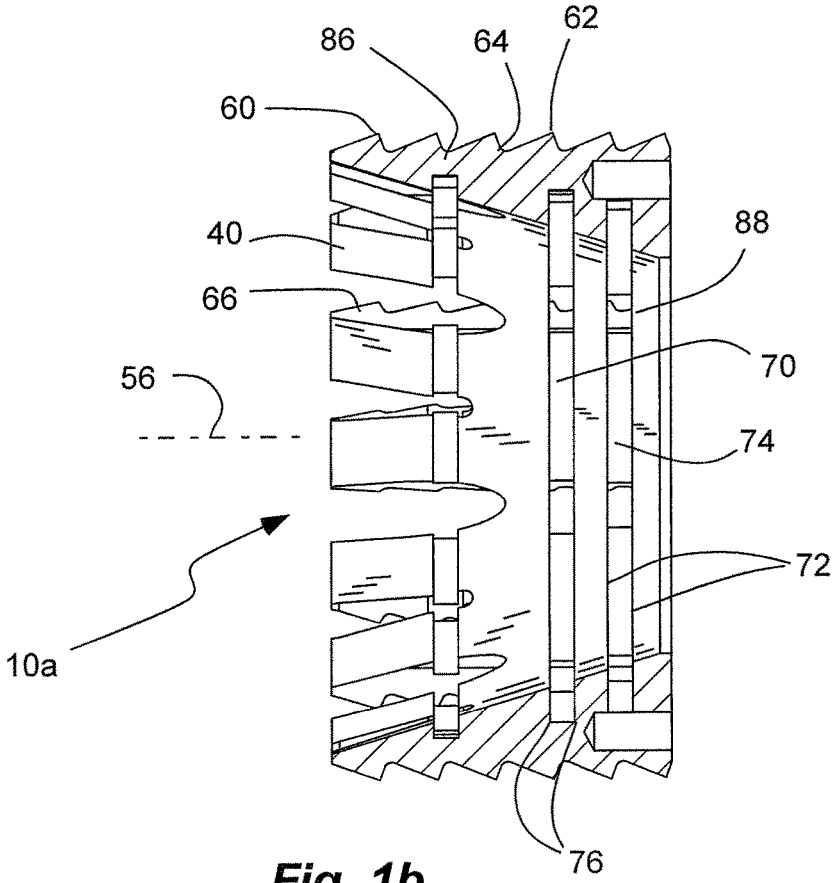
FIG. 1*b* is a cross-sectional side view of the slip of FIG. 1*a*, taken along line 1*b* in FIG. 1*c;*
Figure 1C:
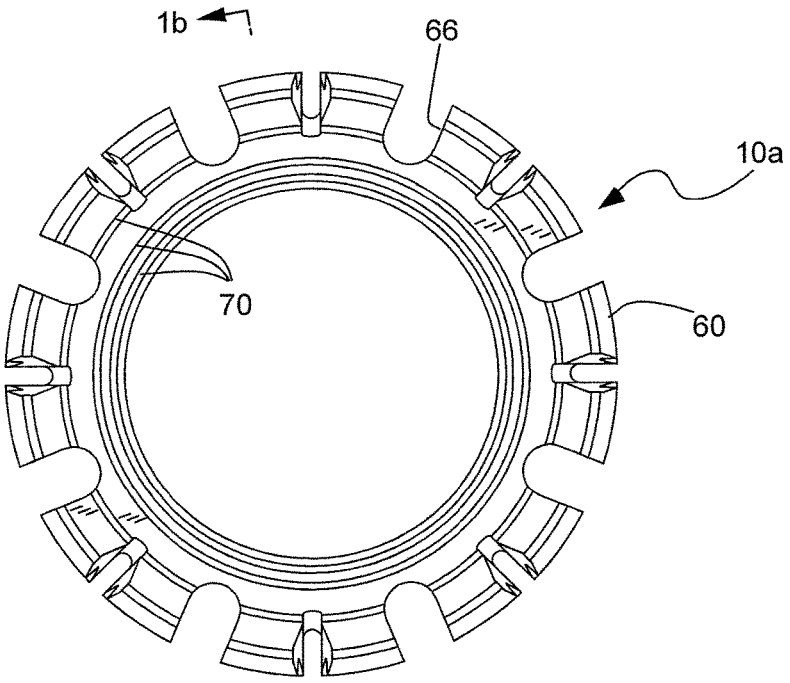
FIG. 1*c* is an end view of the slip of FIG. 1*a;*
Figure 1D:
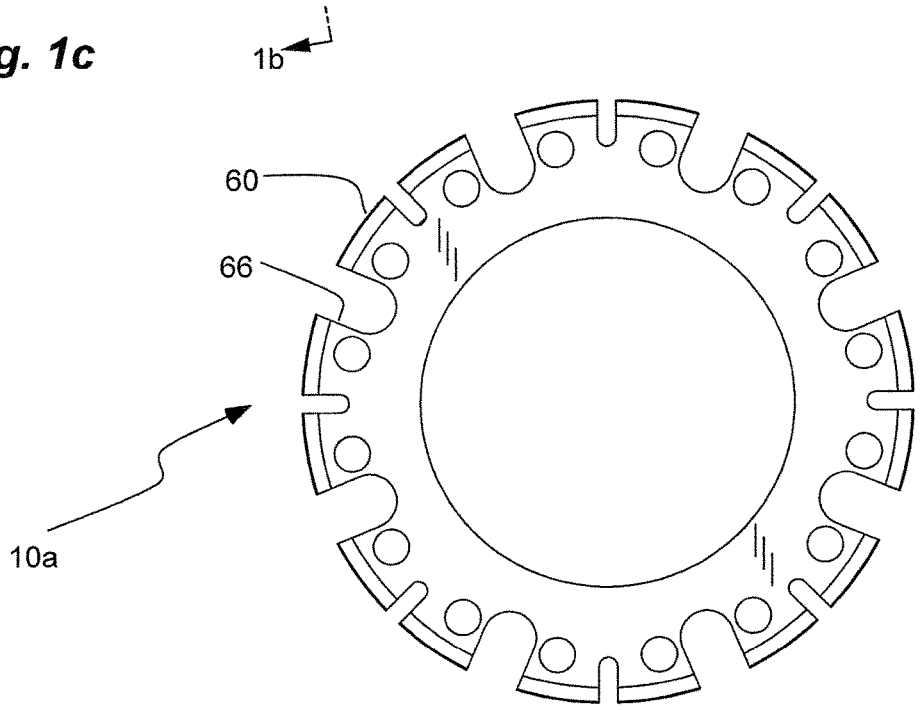
FIG. 1*d* is an opposite end view of the slip of FIG. 1*a;*
Figure 2A:
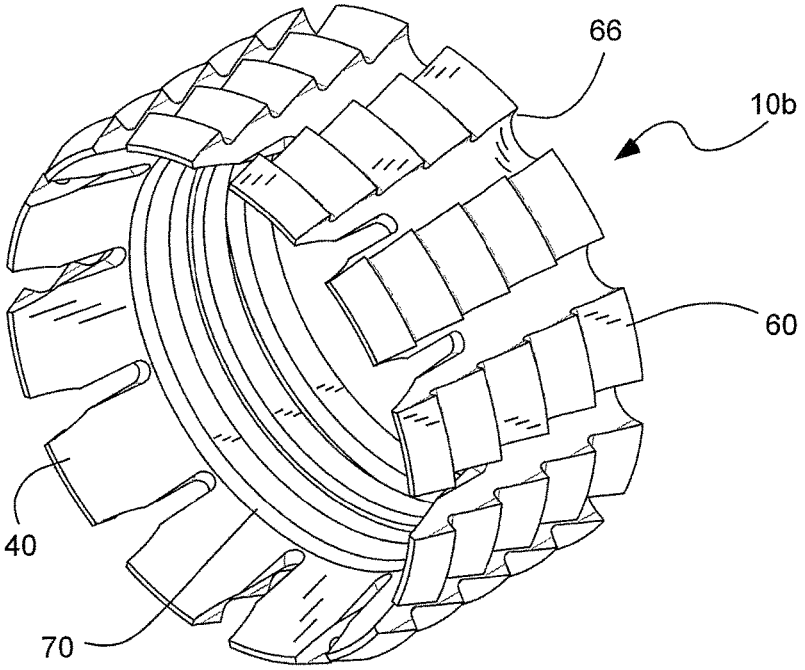
FIG. 2*a* is a perspective view of another slip for a plug in accordance with another embodiment of the present invention.
Figure 2B:
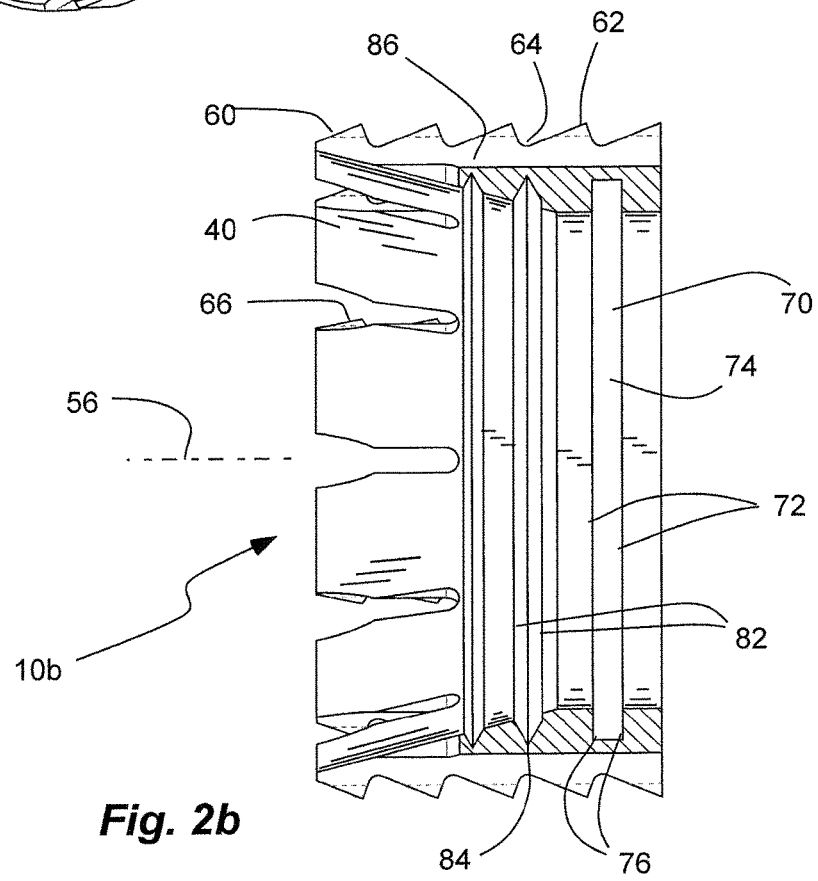
FIG. 2*b* is a cross-sectional side view of the slip of FIG. 2*a*, taken along line 2*b* in FIG. 2*d;*
Figure 2C:
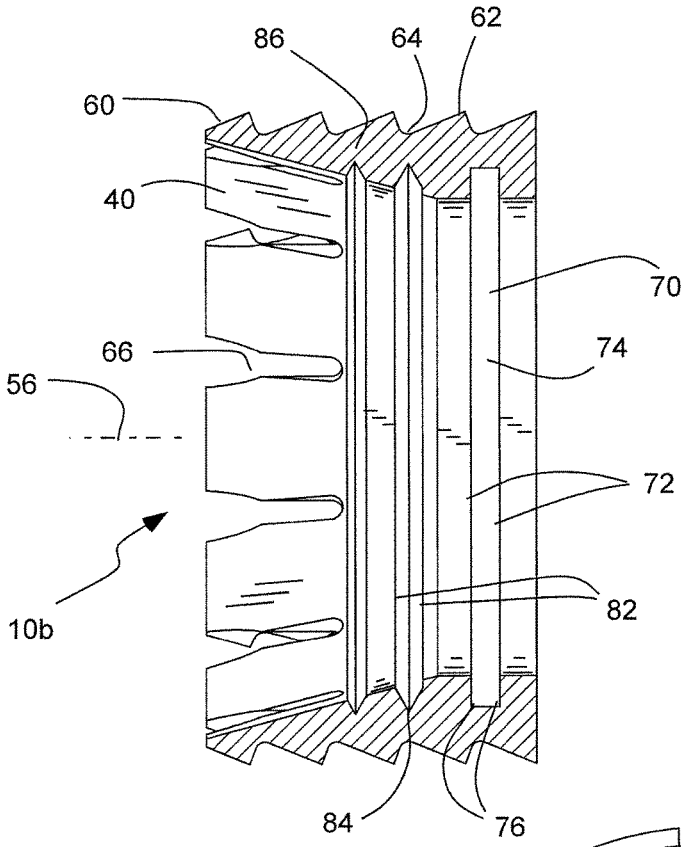
FIG. 2*c* is a cross-sectional side view of the slip of FIG. 2*a*, taken along line 2*c* in FIG. 2*d;*
Figure 2D:
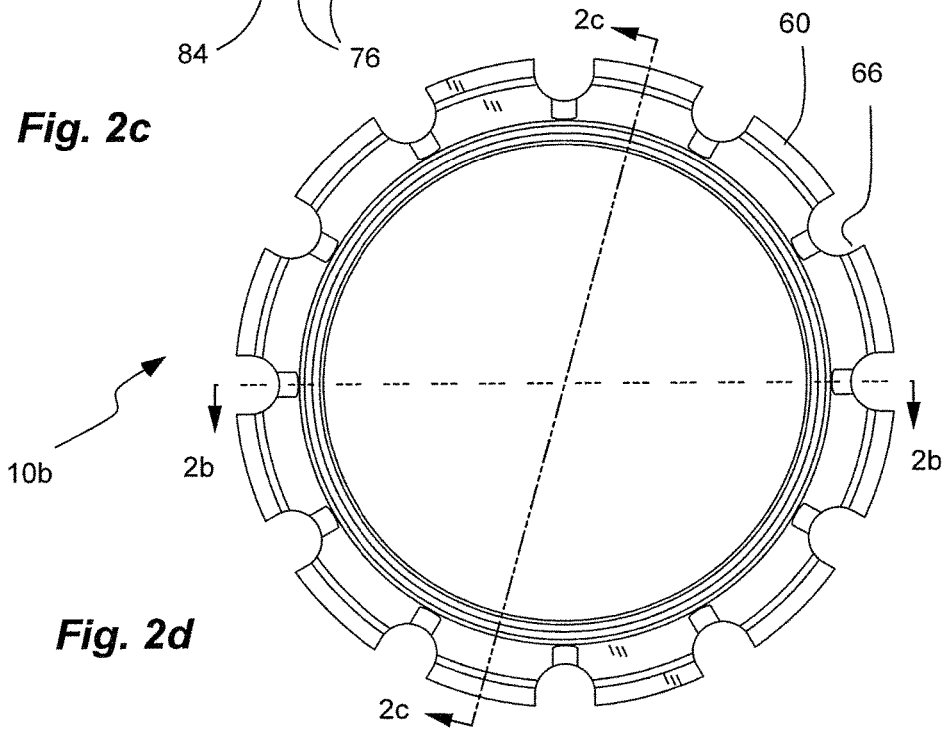
FIG. 2*d* is an end view of the slip of FIG. 2*a;*
Figure 3:
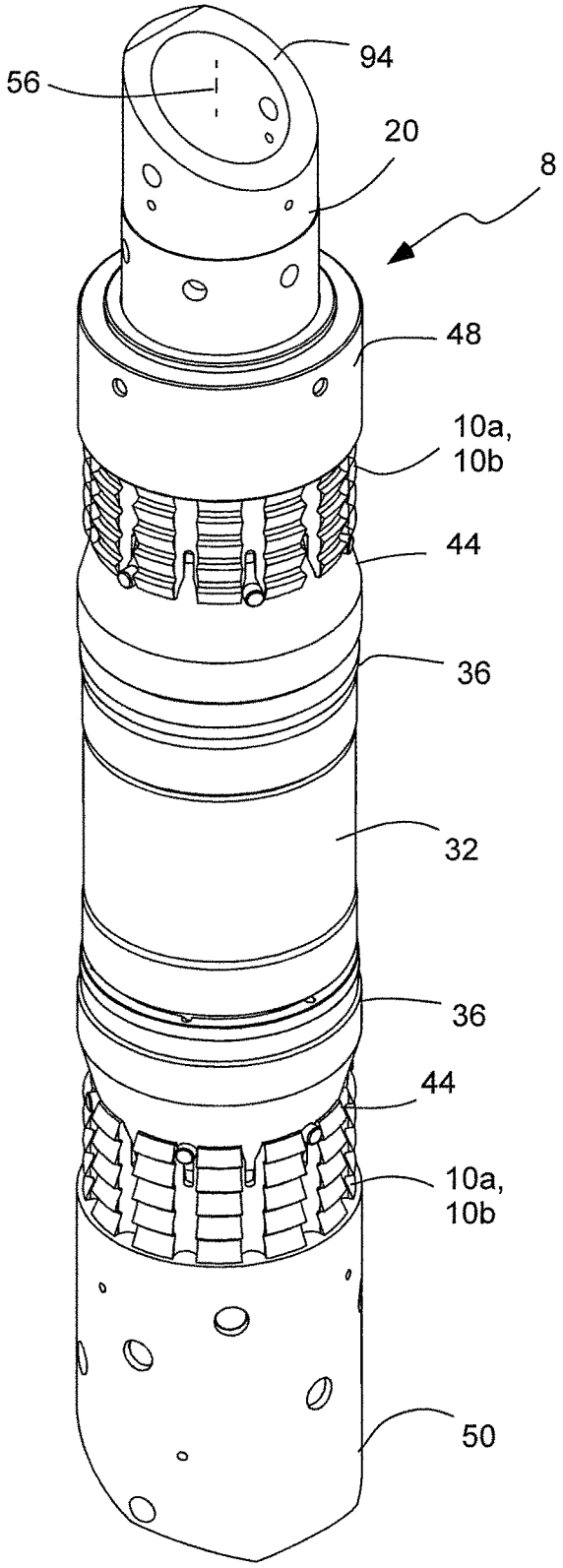
FIG. 3 is a perspective view of a plug with the slip of either FIG. 1*a* or 2*a* in accordance with an embodiment of the present invention.
Figure 4:
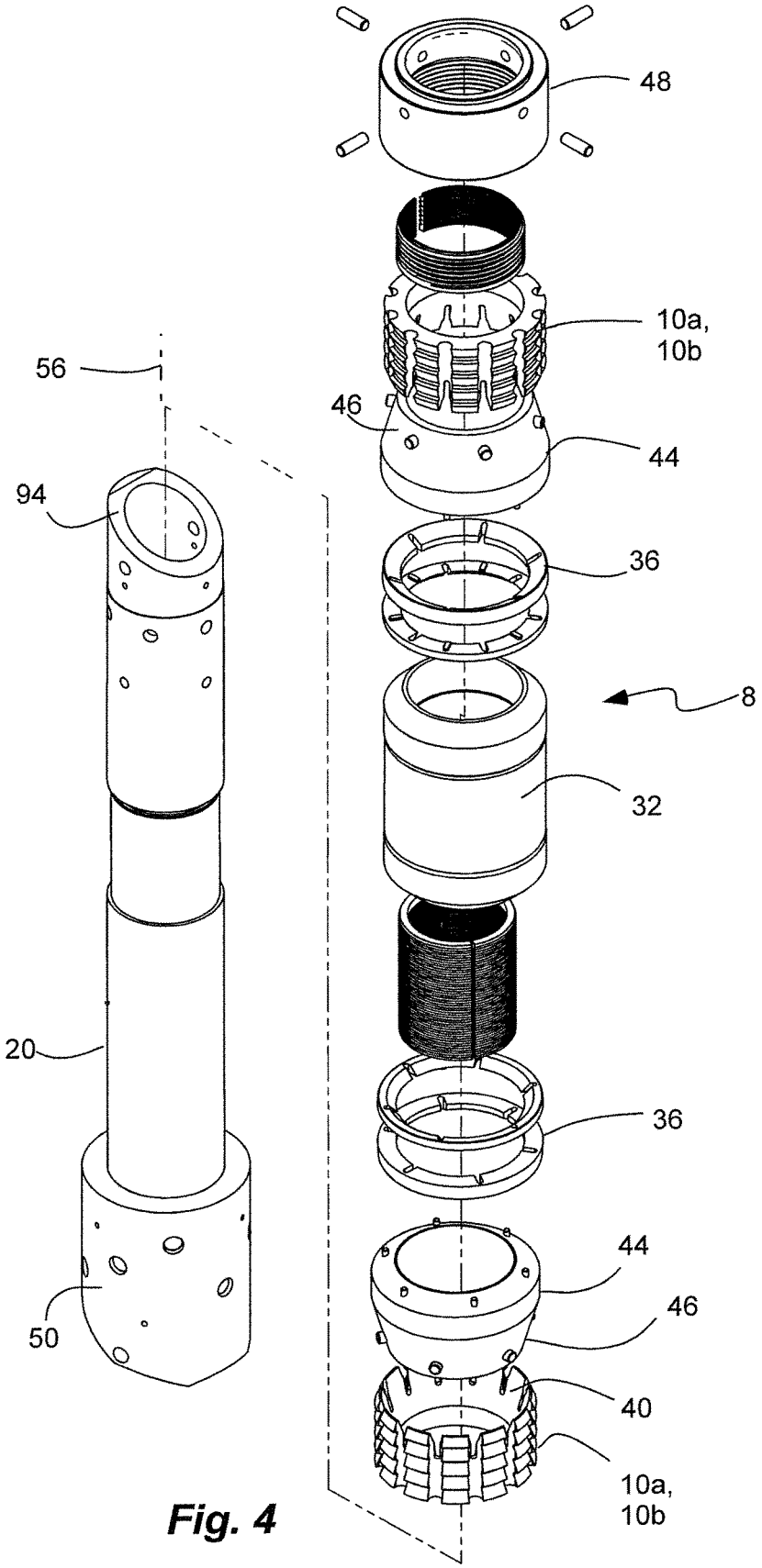
FIG. 4 is an exploded view of the plug of FIG. 3.
Figure 5:
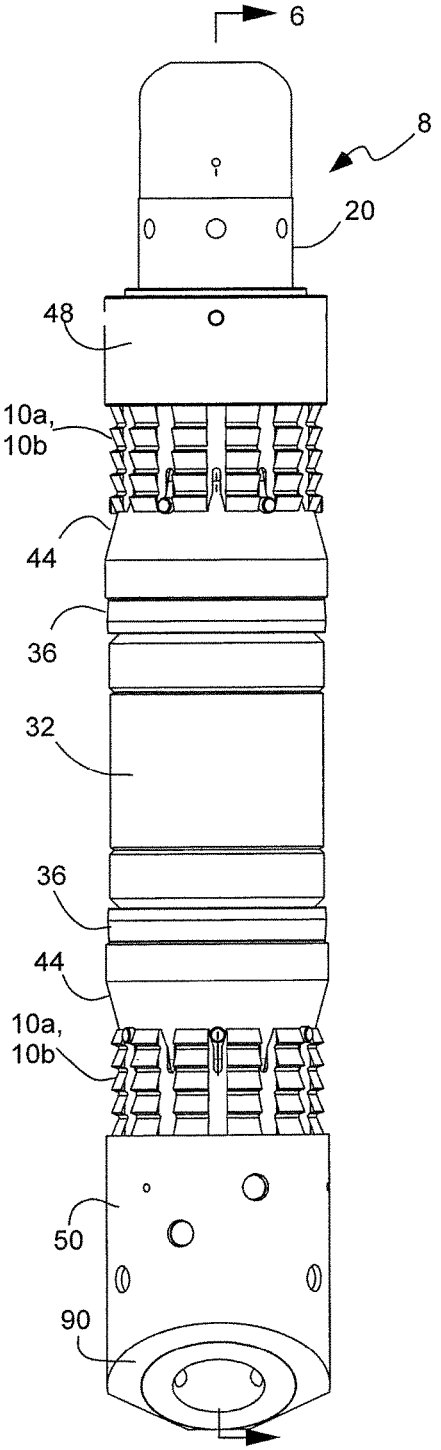
FIG. 5 is a side view of the plug of FIG. 3.
Figure 6:
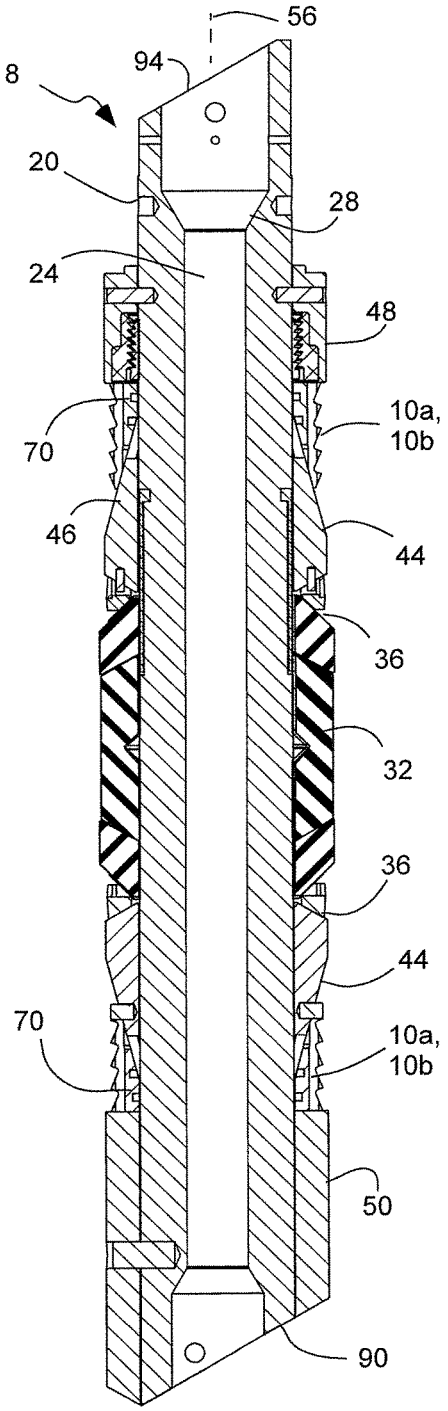
FIG. 6 is a cross-sectional side view of the plug of FIG. 3 taken along line 6 of FIG. 5.

As illustrated in FIGS. 1*a*-6, a slip or slip ring, indicated generally at 10*a* (FIGS. 1*a-d*) and 10*b* (FIGS. 2*a-d*), in an example implementation in accordance with the invention are shown for a plug 8 (FIGS. 3-6) for use in a casing or pipe of an oil or gas well. The slips can be one-piece or single-piece cast iron slips with interior annular grooves to assure that the cast iron slip fragments break into even smaller fragments during drilling or drill out. The lighter fragments can be light enough to be lifted to the surface and away from the cutting face of the drill bit used in the drill out. The smaller fragments reduce the chance of the slip fragments flowing behind the drill bit assembly on a coiled tubing unit and causing the coiled tubing to become stuck when pulling out of the well. The slip can have a plurality (e.g. three to six) interior, annular grooves machined around the circumference on the interior of the slip. The grooves can be centered on a root or gullet of a tooth on the exterior of the slip. The depth of the groove can be designed to provide enough strength to allow for safe handling, deployment (run into the well), setting and then withstanding the pressure from the hydraulic fracking (up to 10,000 psi) done above the plug.

The grooves can be located such that they create a thinner section of metal in the slip. When the slip is removed, the action of the drill or mill tears the slip section away from the cone. The fragments can then tumble around inside the casing. They can be worn, crushed and broken along planes of greatest weakness. The grooves can act to force the slip base to be broken into smaller and smaller pieces.

In the previous designs, the thinnest parts of the slip fragments are broken off until only the base of the slip segment is left. Then the base is simply lightly worn by the tumbling action of the bit or mill rotating inside the casing. The unbroken slip bases are not pumped to the surface and continue to tumble around inside the casing forming a debris cloud inside the casing. This causes increased wear on the drill or mill and longer drill out times for each plug.

Trials in horizontal wells in shale show the internal, annular grooves of the present invention in one-piece slips dramatically reduce drill out time by creating smaller plug cuttings (drilling debris).

The plug 8 can be configured as one of various different type plugs, such as a bridge plug to restrict flow in either direction (up and down), a fracture ("frac") plug to restrict flow in one direction (typically down), a soluble insert plug that begins as a bridge plug, but then transitions to a frac plug after a predetermined time or condition in the well, etc. It will be appreciated that the plug can be configured as other types of plugs as well. Various aspects of such plugs are shown in U.S. patent application Ser. No. 11/800,448 (U.S. Pat. No. 7,735,549); Ser. No. 12/253,319 (U.S. Pat. No. 7,900,696); Ser. No. 12/253,337; 12/353,655 (U.S. Pat. No. 8,127,856); Ser. No. 12/549,652 (61/230,345); and Ser. No. 12/916,095; which are herein incorporated by reference. The slips 10*a* and 10*b* and the plug 8 can be configured for various different sizes of casing or pipe. The slip 10*a* shown in FIGS. 1*a-d* can be sized configured for a 5½ inch plug (or casing), while the slip 10*b* shown in FIGS. 2*a-d* can be sized and configured for a 4½ inch plug (or casing).

The plug or downhole tool 8 includes a center mandrel or mandrel 20 (FIGS. 3-6) that can be made of, or that can include, a composite material, such as a fiber in a resin matrix. The mandrel 20 holds or carries various other components which allow it to be coupled to a setting tool that is lowered into the casing of the well, and which allow it to engage and seal with the casing. Thus, the mandrel has an outer diameter less than an inner diameter of the casing of the well. In one aspect, the plug 8 can be configured for a 5½ inch well, or can be a 5½ inch plug. The slip 10*a* can be configured for a 5½ inch well and plug. In another aspect, the plug 8 can be configured for a 4.5 inch well, or can be a 4.5 inch plug. The slip 10*b* can be configured for a 4.5 inch well and plug. The mandrel can have a center bore 24 (FIG. 6) which can allow for the flow from the reservoir below when the plug is configured as a frac plug. In addition, the mandrel can have a seat 28 (FIG. 6) disposed in the bore 24. The seat can be formed by an internal annular flange in the bore. The upper portion of the bore, at a top of the plug, and the seat can be configured to receive various different components to determine the type of plug and operating characteristics. For example, a fixed bridge plug can be fixed in the upper portion of the bore and can abut to the seat to seal the bore and form the plug as a bridge plug. As another example, a ball or the like can be movably retained in the upper portion of the bore and movable against and away from the seat, forming a one way check valve, to configure the plug as a frac plug.

One or more rubber elements 32 or packers (FIGS. 3-6) are disposed on and carried by the mandrel. The elements (packers) 32 can include one or more compressible rings. Under longitudinal or axial pressure or force, the elements compress longitudinally and expand radially (outward to the casing of the well and inwardly to the mandrel) to fill a space between the mandrel and the casing of the well, thus forming a seal. In addition, one or more backing rings 36 (FIGS. 3-6), such as upper and lower backing rings, can be disposed at opposite sides of the elements (packers) and carried by the mandrel to resist longitudinal or axial extrusion of the elements (packers) under pressure. As described above, one or more frangible slips or slip rings 10*a* or 10*b* (such as upper and lower slips or slip rings) are disposed at opposite sides of the elements (packers) and carried by the mandrel. The slips 10*a* and 10*b* can have teeth on the exterior surface, and can expand or fracture radially to engage and grip the casing of the well. The slip ring 10*a* and 10*b* have a tapering open end 40. One or more cones 44 (FIGS. 3-6) (such as upper and lower cones) or slip wedges can be carried by the mandrel and associated with each of the one or more slips adjacent the slips to radially displace and fracture the slip rings as the cone and the slip ring are pressed together. The cone 44 has a tapered circular frusto-conical end 46 (FIG. 6) insertable into the tapering open end 40 of the slip ring.

Above and below these components are a push sleeve or assembly 48 (FIGS. 3-6) and a lower anvil or mule shoe 50 (FIGS. 3-6) which are structural features designed to resist the hydrostatic, hydrodynamic and compression loads acting on the plug and the elements and their related hardware. Thus, the setting tool presses down on the push sleeve assembly 48, which in turn presses the components against the anvil 50 (or the mule shoe), causing the elements to expand radially and seal, and causing the slips to fracture, slide outward on the cones, and radially bite into the casing to secure the plug in place. In another aspect, the plug can have a fixed top stop rather than an upper push sleeve; and the setting sleeve can slide over the fixed top stop and act directly on the slip to compress the slips, cones, backing rings and elements. As indicated above, components installed in the upper end of the mandrel determine whether the plug will act as a "frac" or "bridge" plug or some other type of plug. The plug can be field configurable, such as by a tool hand "on site" at the well, as a bridge, frac, and/or soluble insert plug. The plug can be shipped direct to the field as described above, with an assembly of elements to seal the casing; backing rings, cones and slips on the mandrel. These components are crushed, pressed or compressed as a setting sleeve acts upon the push sleeve assembly. The elements are forced out to seal the steel casing's inner diameter and the compression load needed to create and maintain the seal is maintained by the slips which lock to the casing's inner diameter or interior. A locking ring inside the push sleeve or push sleeve assembly locks onto a mandrel sleeve which is retained in the composite mandrel via a recess. The teeth in the lock ring and mandrel sleeve prevent the push sleeve from moving backward towards its original position. The compression load needed to create and maintain the seal is maintained by the push sleeve, slips and the anvil. The anvil is held to the mandrel with pins. The slips lock onto the casing's inner diameter or interior. The push sleeve and anvil keep the components compressed. The compression loads acting on the slips are about 25,000 lbs, and must be maintained for weeks or even months at a time.

As described above, the mandrel 20 (FIGS. 3-6) can be formed of, or can include, a composite material. The mandrel 20 can have a substantial diameter, except for annular recesses, and except for the anvil 50, which can be formed with the mandrel resulting in a larger lower diameter, or affixed thereto such as with pins. Similarly, the cones 44 can be formed of, or can include, a composite material, such as fiberglass or carbon. Alternatively, the cones and/or mandrel can be formed of metal, such as aluminum. The slips 10*a* and 10*b* can be formed of metal, such as cast iron. Each of the slips 10*a* and 10*b* can be formed as a single piece, and can be a single-piece slip. The cast iron material of the slips assists in securing the plug in the well casing, while the composite material of the mandrel and the cones eases the drill out procedure. The plug or mandrel, and the slips 10*a* and 10*b*, can have a longitudinal axis 56 (FIGS. 3-6).

As described above, the slip ring(s) 10*a* and 10*b* can be single-piece cast iron slips or slip rings. The slip ring(s) 10*a* and 10*b* can have a plurality of teeth 60 on the exterior and formed in an exterior surface of the rings. The teeth 60 can be spaced-apart axially along the ring, and extending along the entire length of the ring. Each tooth can be substantially annular and can circumscribe the ring, except for portions segmented by the slots, as described subsequently. Each tooth can have an outermost tip 62 and an innermost gullet 64 or root. The tip can be flanked by gullets, and/or the gullets or roots can be flanked by tips. The slips or slip rings can have a plurality of exterior, axial slots 66 spaced-apart around the circumference of the slip ring and extending into the exterior surface or exterior of the slip ring. Thus, as described previously, the teeth 60 can be radially segmented around a circumference of the slip ring by the plurality of axial slots 66 spaced-apart around the circumference of the slip ring and extending into an exterior of the slip ring. The axial slots 66 form axial break lines along which the slip ring can break during setting of the plug. The slips can break or segment into a plurality of slip segments. The slip ring or interior thereof can have an inner surface with a frusto-conical shape to facilitate fragmentation by the cone.

The slip rings 10*a* and 10*b* have a plurality of internal, annular grooves 70 formed in an interior of the slip ring. The grooves 70 are axially spaced-apart from one another. Thus, an interior or interior surface of the slip ring 10*a* and 10*b* is axially segmented along the longitudinal axis 56 by the plurality of annular grooves 70 spaced-apart along the longitudinal axis of the slip ring, and extending into the interior of the slip ring. As the plug is set, the slips break or segment into a plurality of slip segments with internal, arcuate groove segments, and the annular grooves fragment into the arcuate groove segments. The internal, arcuate groove segments form break lines along which the plurality of slip segments break or segment during drill out. As described above, the slip rings 10*a* and 10*b* can have between three and six grooves. In one aspect, the slip rings can have a length of approximately 2.2 inches, and three grooves. The grooves can have a higher concentration at a thicker portion of the slip rings, or where a wall of the slip rings in greater. The slip rings can taper, or can have a wall that tapers, from a thicker portion to a narrower portion. In one aspect, the grooves can align with the first two roots or gullets of the teeth from the thicker portion, or end with the thicker portion.

In one aspect, one or more of the plurality of internal, annular grooves 70 can have a square cross-section defined by substantially parallel side walls 72 and a bottom wall 74 substantially perpendicular to the side walls. The side walls can be perpendicular to the longitudinal axis, while the bottom wall can be annular and can circumscribe the longitudinal axis. The side walls and bottom wall can define a pair of corners 76 between the side walls and the bottom wall. In another aspect, one or more of the plurality of internal, annular grooves 70 can have a triangular cross-section defined by side walls 82 oriented at an acute angle with respect to one another, and defining a corner 84 at an apex between the sides walls. The side walls can be transverse to the longitudinal axis. The corners can form or can define fracture lines about which the slips or slip segments can fragment.

Each of the grooves 70 can be aligned with a different one of the gullets 64 or roots of the teeth 60 formed in the slip ring. As described above, the grooves can have a higher concentration at a wider portion of the slip rings, or can have groove aligned with the first two or three gullets or roots from the thicker end, to help segment or fragment the larger, and heavier portions of the slip rings or segments. Thus, the grooves and the gullets of the teeth together form a plurality of annular portions 86 with a narrower cross section between thicker portions defined between the tips of the teeth and the inner surface of the slips. The narrower portions can define break lines about which the slip segments break during drill-out.

In one aspect, one or more of the plurality of internal, annular grooves 70 can intersect the plurality of axial slots 66 to form a plurality of openings 88 through the slip ring. The grooves can have a depth extending to the slots, and/or the slots can have a depth extending to the grooves. The intersecting slots and grooves can further facilitate fragmentation of the slips during setting and drill-out.

The downhole tool can also include means on the bottom of the mandrel for engaging a top of another downhole tool disposed under the mandrel to resist rotation of the mandrel with respect to the another downhole tool. For example, the mandrel 20 can have an angled bottom 90 (FIG. 6) on a bottom of the mandrel forming an acute angle with respect to the longitudinal axis 56 of the mandrel. In addition, the mandrel 20, or the another mandrel, can have an angled top 94 on a top of the mandrel forming an acute angle with respect to the longitudinal axis of the mandrel. Thus, as the downhole tool (defining an upper downhole tool) is drilled out and falls onto another downhole tool (defining a lower downhole tool), the angled bottom 90 of the (upper) downhole tool engages the angled top 94 of the another (lower) downhole tool so that the another (lower) downhole tool holds the (upper) downhole tool from moving so that it can be further drilled out (as opposed to rotating with the drill bit). Other means for engaging the top of another downhole tool can include mating lugs; mating screw threads; half circle style of cut at each end; crenellated ends etc.

Various aspects of plugs and slips can be found in U.S. Pat. Nos. 7,900,696; 8,127,856; 8,579,023; 8,267,177; 8,678,081; 8,746,342; 8,770,276; and U.S. patent application Ser. No. 13/469,937, filed May 11, 2012; which are herby incorporated herein by reference.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A plug device disposable in a casing of an oil or gas well, the plug device comprising:

a) a mandrel with an element disposed thereon compressible and radially expandable to seal between the mandrel and the casing, and with a slip ring disposed thereon radially expandable to engage the casing, and with a cone adjacent the slip ring to radially displace the slip ring, and with the element, the slip ring and the cone being pressable against a mule shoe on the mandrel;

b) the slip ring having a plurality of external teeth formed in an exterior of the slip ring, and spaced-apart axially along the slip ring;

c) the slip ring having a plurality of axial slots spaced-apart around a circumference of the slip ring and extending into the exterior of the slip ring; and d) the slip ring having a plurality of internal, annular grooves formed in an interior of the slip ring axially spaced-apart and independent from one another, wherein at least one of the plurality of internal, annular grooves intersects the plurality of axial slots to form a plurality of openings through the slip ring.

2. The plug device in accordance with claim 1, wherein the plurality of axial slots form axial break lines along which the slip ring breaks during setting of the plug into a plurality of slip segments with internal, arcuate groove segments; and wherein the internal, arcuate groove segments form break lines along which the plurality of slip segments break during drill out.

3. The plug device in accordance with claim 1, wherein at least one of the plurality of internal, annular grooves has a square cross-section defined by substantially parallel side walls and a bottom wall substantially perpendicular to the side walls, and defining a pair of corners between the sides walls and the bottom wall.

4. The plug device in accordance with claim 1, wherein at least one of the plurality of internal, annular grooves has a triangular cross-section defined by side walls oriented at an acute angle with respect to one another, and defining a corner at an apex between the sides walls.

5. The plug device in accordance with claim 1, further comprising:

a) the plurality of external teeth having gullets defined between tips; and b) the plurality of internal, annular grooves each being aligned with a different gullet.

6. The plug device in accordance with claim 1, wherein each of the plurality of internal, annular grooves is aligned with a different gullet of the plurality of external teeth.

7. The plug device in accordance with claim 1, wherein the slip ring has an inner surface with a frusto-conical shape.

8. The plug device in accordance with claim 1, wherein at least one of the plurality of internal, annular grooves has a triangular cross-section defined by side walls oriented at an acute angle with respect to one another, and defining a corner at an apex between the sides walls.

9. A plug device disposable in a casing of an oil or gas well, the plug device comprising:

a) a mandrel;

b) an element carried by the mandrel and axially displaceable along the mandrel during setting and compressible and radially expandable to seal between the mandrel and the casing when set;

c) at least one frangible slip ring carried by the mandrel and radially expandable during setting to fragment and engage the casing when set;

d) at least one cone carried by the mandrel and adjacent the at least one slip ring and axially displaceable during setting to fragment and radially displace the slip ring;

e) a lower mule shoe fixed with respect to the mandrel;

f) the element, the at least one slip ring and the at least one cone being pressable against the lower mule shoe on the mandrel during setting;

g) the slip ring having a tapering open end;

h) the cone having a tapered circular frusto-conical end insertable into the tapering open end of the slip ring;

i) a plurality of external teeth formed in an exterior of the slip ring, and spaced-apart axially along the slip ring;

j) the slip ring having a plurality of slots spaced-apart around a circumference of the slip ring and extending into the exterior of the slip ring; and k) the slip ring having a plurality of internal, annular grooves formed in an interior of the slip ring axially spaced-apart and independent from one another, wherein at least one of the plurality of internal, annular grooves intersects the plurality of axial slots to form a plurality of openings through the slip ring.

10. The plug device in accordance with claim 9, wherein the plurality of axial slots form axial break lines along which the slip ring breaks during setting of the plug into a plurality of slip segments with internal, arcuate groove segments; and wherein the internal, arcuate groove segments form break lines along which the plurality of slip segments break during drill out.

11. The plug device in accordance with claim 9, wherein at least one of the plurality of internal, annular grooves has a square cross-section defined by substantially parallel side walls and a bottom wall substantially perpendicular to the side walls, and defining a pair of corners between the sides walls and the bottom wall.

12. The plug device in accordance with claim 9, further comprising:

a) the plurality of external teeth having gullets defined between tips; and b) the plurality of internal, annular grooves each being aligned with a different gullet.

13. The plug device in accordance with claim 9, wherein each of the plurality of internal, annular grooves is aligned with a different gullet of the plurality of external teeth.

14. A frangible slip device configured for a plug disposable in a casing of an oil or gas well, the slip device comprising:

a) a frangible slip ring disposable on a mandrel and radially expandable during setting to fragment and radially expand to engage the casing;

b) a plurality of external teeth formed in an exterior of the slip ring, and spaced-apart axially along the slip ring;

c) the plurality of teeth being radially segmented around a circumference of the slip ring by a plurality of axial slots spaced-apart around the circumference of the slip ring and extending into the exterior of the slip ring;

d) an interior of the slip ring being axially segmented along a longitudinal axis by a plurality of annular grooves spaced-apart and independent from one another along the longitudinal axis of the slip ring and extending into the interior of the slip ring; and e) the plurality of axial slots forming axial break lines along which the slip ring fragments during setting of the plug into a plurality of slip segments with internal, arcuate groove segments; and the internal, arcuate groove segments forming break lines along which the plurality of slip segments fragment during drill out, wherein at least one of the plurality of internal, annular grooves intersects the plurality of axial slots to form a plurality of openings through the slip ring.

15. The slip device in accordance with claim 14, wherein at least one of the plurality of internal, annular grooves has a square cross-section defined by substantially parallel side walls and a bottom wall substantially perpendicular to the side walls, and defining a pair of corners between the sides walls and the bottom wall.

16. The slip device in accordance with claim 14, wherein at least one of the plurality of internal, annular grooves has a triangular cross-section defined by side walls oriented at an acute angle with respect to one another, and defining a corner at an apex between the sides walls.

17. The slip device in accordance with claim 14, wherein each of the plurality of internal, annular grooves is aligned with a different gullet of the plurality of external teeth.

* * * * *